US009410418B2

(12) United States Patent
Papouras et al.

(10) Patent No.: US 9,410,418 B2
(45) Date of Patent: Aug. 9, 2016

(54) REAL TIME WELL DATA ALERTS

(75) Inventors: Chris Papouras, Houston, TX (US); Pradeep Annaiyappa, Houston, TX (US); Hari Koduru, The Woodlands, TX (US)

(73) Assignee: Canrig Drilling Technology Ltd., Houston, TX (US)

( * ) Notice: Subject to any disclaimer, the term of this patent is extended or adjusted under 35 U.S.C. 154(b) by 1952 days.

(21) Appl. No.: 11/847,048

(22) Filed: Aug. 29, 2007

(65) Prior Publication Data

US 2009/0058674 A1 Mar. 5, 2009

(51) Int. Cl.
*E21B 47/00* (2012.01)

(52) U.S. Cl.
CPC ..... *E21B 47/00* (2013.01)

(58) Field of Classification Search
CPC ..... E21B 43/12; E21B 44/00; E21B 34/16; G06F 17/40
USPC ..... 340/853.2
See application file for complete search history.

(56) References Cited

U.S. PATENT DOCUMENTS 4,468,665 A * 8/1984 Thawley ..... E21B 47/122 33/312
4,794,534 A 12/1988 Millheim
5,732,776 A * 3/1998 Tubel et al. ..... 166/250.15
5,983,164 A 11/1999 Ocondi
6,101,445 A * 8/2000 Alvarado et al. ..... 702/9
6,176,312 B1 * 1/2001 Tubel et al. ..... 166/250.15
6,456,902 B1 9/2002 Streetman
6,510,350 B1 1/2003 Steen, III et al.
6,873,267 B1 3/2005 Tubel et al.
7,096,092 B1 * 8/2006 Ramakrishnan et al. ..... 700/281
7,477,160 B2 * 1/2009 Lemenager et al. ..... 340/853.1
8,386,059 B2 2/2013 Boone
2004/0182606 A1 9/2004 Goldman et al.
2005/0096846 A1 * 5/2005 Koithan et al. ..... 702/6
2005/0161260 A1 7/2005 Koithan et al.
2005/0171698 A1 8/2005 Sung et al.
2005/0189142 A1 9/2005 Garcia et al.
2008/0024318 A1 * 1/2008 Hall et al. ..... 340/853.3
2011/0024187 A1 2/2011 Boone et al.
2013/0127900 A1 5/2013 Pena et al.

OTHER PUBLICATIONS

ISA/US, "Notification of Transmittal of the International Search Report and the Written Opinion of the International Searching Authority, or the Declaration—PCT/US2008/067434," mailed May 13, 2009.
ISA/US, "Written Opinion of the International Searching Authority—PCT/US2008/067434," mailed May 13, 2009.
International Search Report mailed Nov. 21, 2014 in corresponding International Application No. PCT/US2014/047887 (4 pages).

* cited by examiner

*Primary Examiner* — Albert Wong
(74) *Attorney, Agent, or Firm* — Haynes and Boone, LLP

(57) ABSTRACT

A system for remote monitoring of well operations. The system may include an alerts module positioned proximate a well, at least one well parameter sensor in communication with the alerts module, and a well operation control module in communication with the alerts module. The system may further include a remotely positioned well monitoring station in communication with the alerts module, and a user terminal in communication with the well monitoring station.

14 Claims, 3 Drawing Sheets

REAL TIME WELL DATA ALERTS

BACKGROUND OF THE DISCLOSURE

1. Field of the Invention

The present invention relates to a system and method for monitoring well drilling or production activities.

2. Description of the Related Art

The life span of an oil well can generally be described in 5 stages: 1) The well research and planning stage; 2) The well drilling stage; 3) The well completion stage; 4) The oil production stage; and 5) The well closure or abandonment stage. The drilling, completion, and production stages of the oil well are generally monitored closely by various experts in their respective fields to maximize the efficiency and safety of the well during these stages. One example of expert monitoring of a well drilling process can be found in measurement while drilling (MWD) techniques. MWD tools are used by drilling rigs to transmit detailed drilling parameter information in real time from the drilling tool, typically located near the drill bit, to a proximate surface location where the drilling parameter information is reviewed by an expert. The expert, who is often times an drilling operator with tens of years of experience in the drilling industry, generally monitors the drilling parameter information transmitted from the downhole drilling tool to determine if the drilling process is operating at or near an optimal or desired range.

Further, MWD tools are generally capable of taking directional surveys in real time, such as through the use of accelerometers and magnetometers to measure the inclination and azimuth of the wellbore at that location. MWD tools can also provide information about the conditions at the drill bit, such as the rotational speed of the drillstring, smoothness of the rotation, type and severity of any downhole vibration, downhole temperature, torque and weight on bit, mud flow volume, various fluid pressures, etc. On site analysis of the drilling parameter information by the expert allows the operator to drill the well more efficiently, and to ensure that the MWD tool and any other downhole tools, such as mud motors, rotary steering systems, and LWD tools, are operating correctly and are unlikely to fail due to overstress or improper operation.

Another advantage of local expert monitoring is the ability to provide well control. Well control is generally known as the dangerous effects of unexpected high pressures on the surface equipment of drilling rigs searching for oil and/or gas. A drilling fluid is generally used to aid in well control, and failure to manage and control the pressure effects of the drilling fluid is known to cause serious equipment damage and possible injury to those working on the drilling rig. Well control generally includes the monitoring for the "symptoms" of impending pressure imbalance situations and the procedures for operating well site equipment to understand the situation and take remedial or corrective actions prior to an unexpected and dangerous pressure release at the surface of the well (generally known as a blowout).

Although local expert monitoring of each well during the drilling and/or production stages has clearly shown to increase the productivity and safety of the well, having multiple experts on-site at each of thousands of wells being drilled, especially when many current oil wells are configured as offshore platforms, imposes significant manpower allocation challenges on drilling operation companies. Therefore, there is a need in the art for a system and method for experts to remotely monitor and control well operations.

SUMMARY OF THE DISCLOSURE

Various embodiments of the invention provide a system, method, and a computer program embodied on a computer readable medium that is configured to remotely monitor operations at a well drilling location. An alert may be relayed to a remote location when selected measured parameters at the drilling location are outside of a predetermined range. An expert at the remote location may review the alert and transmit adjustments to be made back to the drilling location, where the adjustments are calculated to address the alert.

DETAILED DESCRIPTION

Figure 1:
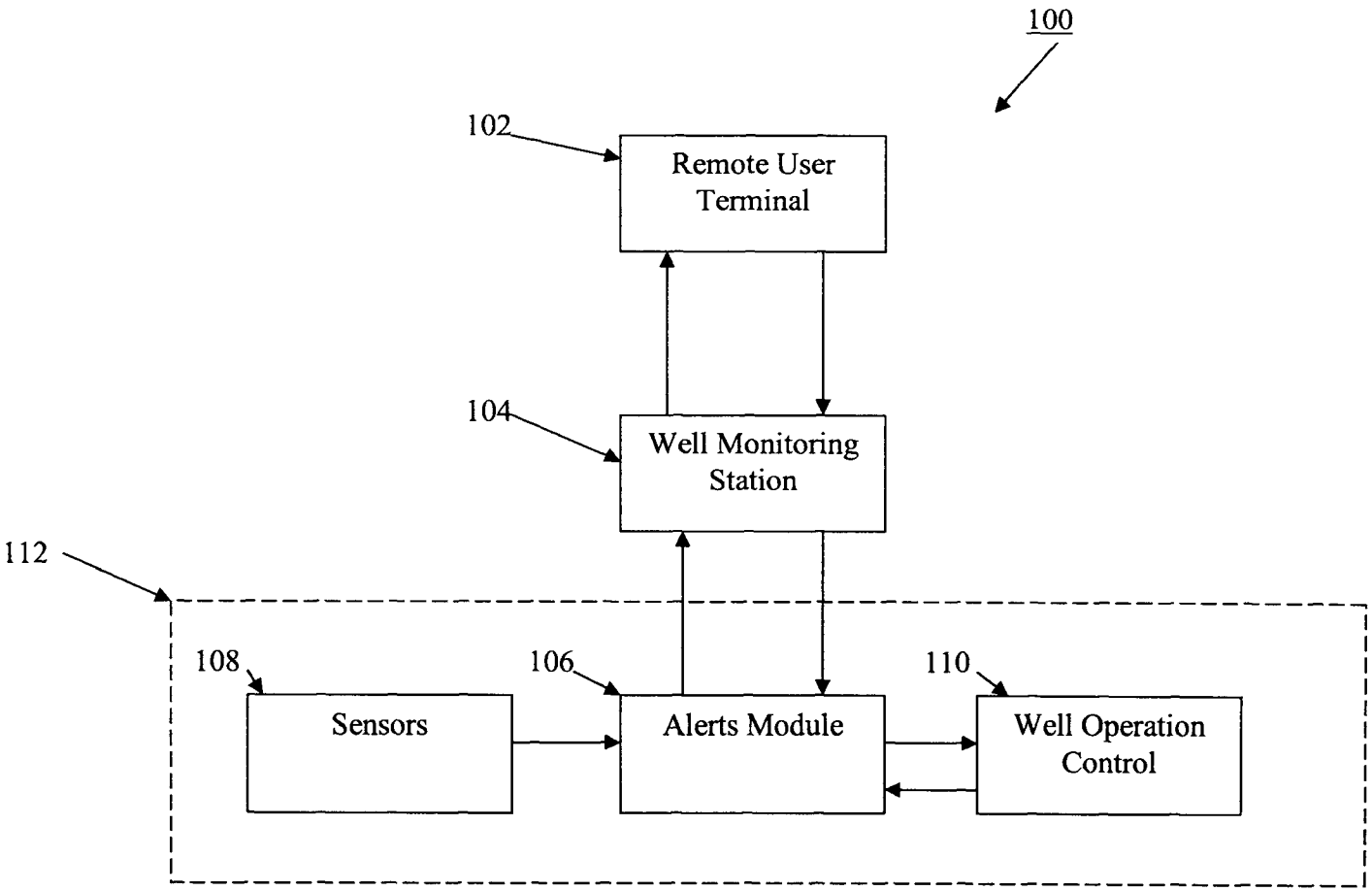
FIG. 1 illustrates an exemplary configuration of a well monitoring system of the invention.

The following detailed description generally references exemplary embodiments of the invention. The invention, however, is not limited to any specifically described exemplary embodiment; rather, any combination of the following features and elements, whether related to a described exemplary embodiment or not, may be used to implement and/or practice the invention. Moreover, in various exemplary embodiments, the invention may provide advantages over the prior art; however, although the exemplary embodiments of the invention may achieve advantages over other possible solutions and the prior art, whether a particular advantage is achieved by a given embodiment is not intended in any way to limit the scope of the invention. Thus, the following aspects, features, exemplary embodiments, and advantages are intended to be merely illustrative of the invention and are not considered elements or limitations of the appended claims; except where explicitly recited in a claim. Similarly, references to "the invention," "Summary of the Invention," or "Field of the Invention" should neither be construed as a generalization of any inventive subject matter disclosed herein nor considered an element or limitation of the appended claims; except where explicitly recited in a claim.

Further, at least one embodiment of the invention may be implemented as a program product for use with a computer system or other type of processing device. The program product may generally be configured to define functions of the embodiments (including the methods) described herein and can be contained on a variety of computer readable media. Illustrative computer readable media include, without limitation, (i) information permanently stored on non-writable storage media (e.g., read-only memory devices within a computer such as CD-ROM disks readable by a CD-ROM drive, or programmable logic devices); (ii) alterable information stored on writable storage media (e.g., floppy disks within a diskette drive or hard-disk drive, writable CD-ROM disks and DVD disks, zip disks, and writable portable memory devices); and (iii) information conveyed across communications media, (e.g., a computer, telephone, wired network, or wireless network). These embodiments also include information shared over the Internet or other computer networks. Therefore, Applicants intend that any computer readable media, when carrying computer-readable instructions that are capable of performing methods or operations associated with the invention when the instructions are executed by a processor, represent an exemplary embodiment of the present invention.

Further still, in general, software routines implementing various elements, parts, or embodiments of the invention may be included as part of a computer operating system or as part of a specific application, component, program, module, object, or sequence of instructions, such as an executable script. Software routines typically include a plurality of instructions capable of being performed using a computer system or other type or processor configured to execute instructions read from a computer readable medium. Also, programs typically include or interface with variables, data structures, other computer programs, etc. that reside in a memory or on storage devices as part of their operation. In addition, various programs described herein may be identified based upon the application for which they are implemented. Those skilled in the art will readily recognize, however, that any particular nomenclature or specific application that follows facilitates a description of the invention and does not limit the invention for use solely with a specific application or nomenclature. Furthermore, the functionality of programs described herein may use a combination of discrete modules or components interacting with one another. Those skilled in the art will recognize, however, that different embodiments may combine or merge such components and modules in a variety of ways not expressly recited in the exemplary embodiments described herein.

FIG. 1 illustrates an exemplary configuration of a well monitoring system 100 of the invention. The well monitoring system is generally configured to provide a remotely positioned person with the ability to monitor drilling or production conditions at a well, which may be positioned offshore or in a remote inland area, for example. The remotely positioned person may be a person having experience in drilling or well production procedures or in another area that is beneficial to the oil drilling or production processes. Although the description of the following embodiments of the well monitoring system are described generally with respect to a well, it is contemplated that the well monitoring system of the invention may be implemented on land based drilling rigs, water based drilling rigs or platforms, or any other type of drilling apparatus. Therefore, regardless of the particular implementation, the exemplary well monitoring system 100 of the invention includes an alerts module 106 that is generally positioned at or proximate the surface of a well. The surface of the well or the location proximate thereto is generally represented in FIG. 1 by the dashed line at 112. The alerts module 106 may generally include a computer or other processing device configured to execute a predetermined processing control program. In one embodiment of the invention, the alerts module includes a computer having an interface board that is configured to receive a plurality of inputs and generate a plurality of outputs in accordance with the inputs received and a predetermined control program. In another embodiment of the invention, the alerts module 106 may be a simple programmable processing unit configured to receive inputs and generate outputs in accordance with the inputs and a predetermined process control program.

The alerts module 106 is in communication with a plurality of sensors 108, which may be positioned at the well head, along the tube string, at or near the drilling bit, associated with the draw-works or other components that are used to control the tube string or down-hole components, anywhere in the well production stream above the well head, or anywhere downhole, such as near the drill bit. Parameters that may be measured by the sensors 108 in a drilling or production scenario include, but are not limited to, weight on bit, rate of penetration, face angle of the drilling implement, choke position, mud motor parameters, flow rates, pressures, or densities of fluid, mud, or gases, torque, rotation speed, electrical currents or loads, vector quantities, distances, durations, weights, volumes, temperatures, orientations, and any other parameter that is generally measured in an oil drilling or production scenario.

Each of the sensors 108 measure their respective parameter and communicate the results of the measurement back to the alerts module 106. In an embodiment of the invention where the alerts module 106 is a computer having an interface board, each of the sensors 108, which may have a digital output, will be in communication with a specific input pin of the interface board. As such, the computer representing the alerts module 106 will receive an input from each of the sensors 108 at the respective pins. The input may be processed by a processing control program on the computer to determine if the well drilling or production operations are being conducted within certain parameters. If one or more of the parameters is not within a desired range, an alert condition occurs and the alerts module may generate an output signal from an output pin of the interface board, where the output signal may be received by another element of the exemplary well monitoring system 100 that is configured to adjust a parameter in the drilling or production process to correct the sensed parameter that is out of the desired range.

The alerts module 106 is also in communication with a well operation control module 110. The well operation control module 110, which may be positioned proximate the well (as indicated by dashed line 112), is generally configured to exercise control over the physical operation of the well. For example, the well operation control module 110 may be configured to receive inputs and generate well control outputs in response to the inputs and in accordance with a well operation control program. In an embodiment of the invention, the well operation control module 110 receives inputs from the alerts module 106, and the received inputs may represent the measured or sensed parameters of the well operating conditions (as measured by sensors 108). The well control outputs generated by the well operation control module 110 may be transmitted to actuators or other devices for adjusting parameters of the well drilling or production process.

Communication between the sensors 108, alerts module 106, and the well operation control module 110 may be through any number of communications media. For example, the sensors 108 may be hard wired to the alerts module 106, or in some embodiments, the sensors may be wireless downhole sensors that communicate topside via RF or other wireless communications methods. Similarly, since both the alerts module 106 and the well operation control module 110 are generally located on the well drilling platform, communication between the alerts module 106 and the well operation control module 110 may be hard wired communication or a type of wireless communication, such as RF communication.

In an embodiment of the invention, the well operation control module 110 may be a computer having an I/O control board and running a well control program thereon. The I/O board may have a plurality of digital input pins and a plurality of digital output pins. The input pins of the I/O board may be monitored by the computer and the output pins may be controlled by the computer. The input pins may receive digital inputs, such as from sensors 108. The output pins may generate control outputs that are received by actuators or other mechanical devices that are configured to convert the output signal into a physical control or adjustment of a well parameter. Thus, in at least one embodiment of the invention, the well operation control module 110 is generally in bi-directional communication with the alerts module 106, as shown in FIG. 1, and with other operation control devices for the drilling rig.

In another embodiment of the invention, the alerts module 106 and the well operation control module 110 are combined into a single component. The combination of the two modules may be done via a single computer, i.e., the functionality of the two modules may be embodied in a single computer program running on a computer or other processing device. Alternatively, the respective modules may be configured as stand alone processing devices, modules, units, engines, or other devices or software routines configured to conduct the functions of the respective modules.

The alerts module 106 is also generally in communication with a remotely positioned well monitoring station 104. The well monitoring station 104 may be positioned at a location away from the well 112, such as at a land based central data hub. For example, in an embodiment of the invention where the well location 112 is an offshore oil drilling platform, the alerts module 106, well operation control module 110, and the sensors 108 will all generally be located on the offshore oil drilling platform, and the well monitoring system 104 will generally be located at a land based operations center, such as a company headquarters or operation control center. The well monitoring station 104 may be in bidirectional communication with the alerts module 106. Although not expressly shown, the well monitoring station 104 may also be in communication with the well operation control module 110.

In embodiments of the invention where the well location 112 is an offshore platform or a well drilling platform positioned in a remote wilderness area, for example, the communication between the well monitoring station 104 and the alerts module 106 may be through a satellite communication system. More particularly, one or more orbital (generally fixed position) satellites may be used to relay communication signals (potentially bi-directional) between the well monitoring station 104 and the alerts module 106 on the offshore platform. Alternatively, radio, cellular, optical, or hard wired signal transmission methods may be used for communication between the alerts module 106 and the well monitoring station 104. In situations where the oil drilling location 112 is an offshore platform, a satellite communications system may be used, as cellular, hard wire, and ship to shore-type systems are in some situations impractical or unreliable.

The well monitoring station 104 may generally be a computer or server configured to interface with a plurality of alerts modules 106 each positioned at different ones of the plurality of well platforms. The well monitoring station 104 may be configured to receive various types of signals (satellite, RF, cellular, hard wired, optical, ship to shore, and telephone, for example) from a plurality of well drilling locations 112 having the alerts module 106 thereon. The well monitoring station 104 may also be configured to transmit selected information from the alerts module 106 to a specific remote user terminal 102 of a plurality of remote user terminals 102 in communication with the alerts module 106. The well monitoring station 104 may also receive information or instructions from the remote user terminal 102. The remote user terminal 102, via the well monitoring station 104 and the alerts module 106, is configured to display drilling or production parameters for the well associated with the alerts module 106.

The well monitoring station 104 may generally be positioned at a central data hub, and may be in communication with the alerts module 106 at the drilling site via a satellite communications link, for example. The monitoring station 104 may be configured to allow users to define alerts based on information and data that is gathered from the drilling site(s) by various data replication and synchronization techniques. As such, may not be truly real time in every embodiment of the invention, as the alerts depend upon data that has been transmitted from a drilling site to the central data hub over a radio or satellite communications medium (which inherently takes some time to accomplish).

In one exemplary embodiment of the invention, the monitoring station 104 may be completely database driven. A novel point of this exemplary embodiment, and the monitoring station 104 in particular, is the concept of a "business object," which is generally an abstract entity that describes a physical entity that needs to be monitored and reported on. One way of understanding a business object is to equate the business object to a physical asset, such as a top drive on a rig. The business object does not need to be a physical object, as the business object could be a database server program, for example. Regardless, the business object is defined as a collection of properties and behaviors that can be defined and stored in database terms, which allows for allows users to define alerts of different kinds by using various permutations and combinations of the properties and behaviors defined on the business object, and allows administrators to create and make available brand new or altered business objects without having to shut down the alerts engine. Both these features are novel and make the monitoring station 104 extremely powerful and useful.

Once a drilling operation is functioning, a business comes to depend on the monitoring station 104 to protect its assets. The monitoring station 104 generally is not shut down or turned off once it is brought online. Therefore, defining the business objects as database entities and exposing them in a dynamic way allows for this availability. Basing the creation and definition of alerts on business objects allows users to create multiple alerts from a single business object.

Figure 3:
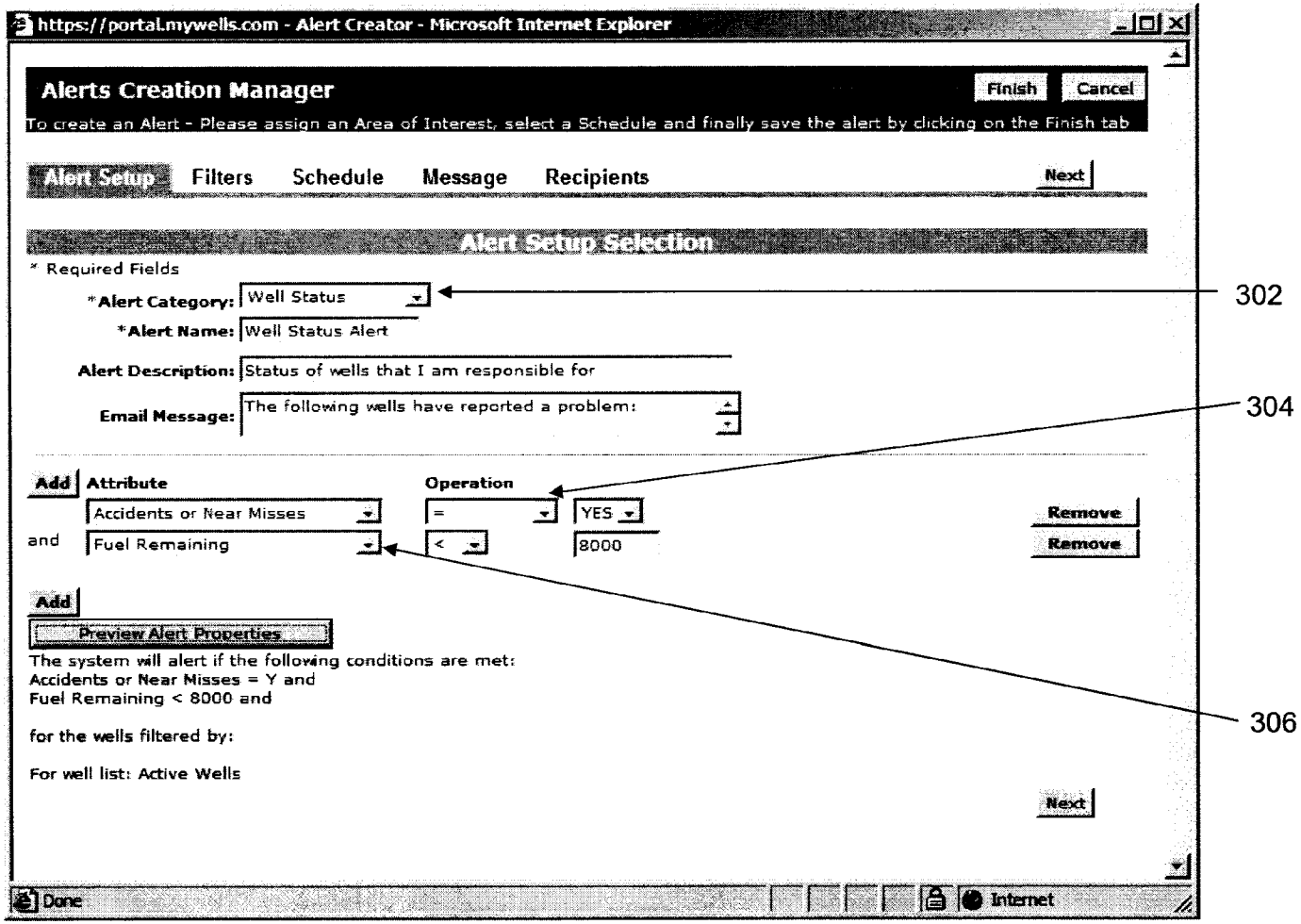
FIG. 3 illustrates a screen-shot of an exemplary alerts module of the invention.

FIG. 3 illustrates a screen-shot of an exemplary alerts module, where 302 is the name of the business object and 306 illustrates two properties that are being monitored by this alert. Although only two properties 306 are illustrated, the invention is not limited to any particular number of properties 306, as there could be a number of additional properties that could have been added to the list for an alert. The operation section 304 and the actual values that the alert is setup against are also generally database and metadata driven, and therefore, when the property 306 is of a particular data type, then the appropriate operations may be made available for the user to select.

In operation, the exemplary well monitoring system 100 of the invention is configured to allow a plurality of remotely positioned experts to monitor critical parameters of a plurality of wells. In general, the components of the well monitoring system 100 positioned at the well location 112 (the sensors 108 and alerts module 106) cooperatively operate to forward selected well parameters to the well monitoring station 104. When the well monitoring station 104 is offshore or in a remote location, the well parameter information may be transmitted to the well monitoring station 104 via satellite relay communications system. The well monitoring station 104 operates to forward the well parameter information to predetermined user terminals 102, wherein the information is reviewed by a well drilling or production expert. The expert may select and transmit corrective actions back to the well via the well monitoring station 104. The corrective actions are received at the well location 112 by the alerts module 106, and transmitted to the well operation control module 110. The well operation control module 110 may then generate outputs configured to correct an issue noted by the expert after reviewing the well parameter information. The outputs from the well operation control 110 may be signals configured to cause an actuator (electric motor, hydraulic actuator, or other devices configured actuate a control on a well drilling or production platform) to physically adjust a parameter at the well. Alternatively, the output from the well operation control 110 may be a visual or audible signal for an operator on the well that indicates that a manual change should be made.

Figure 2:
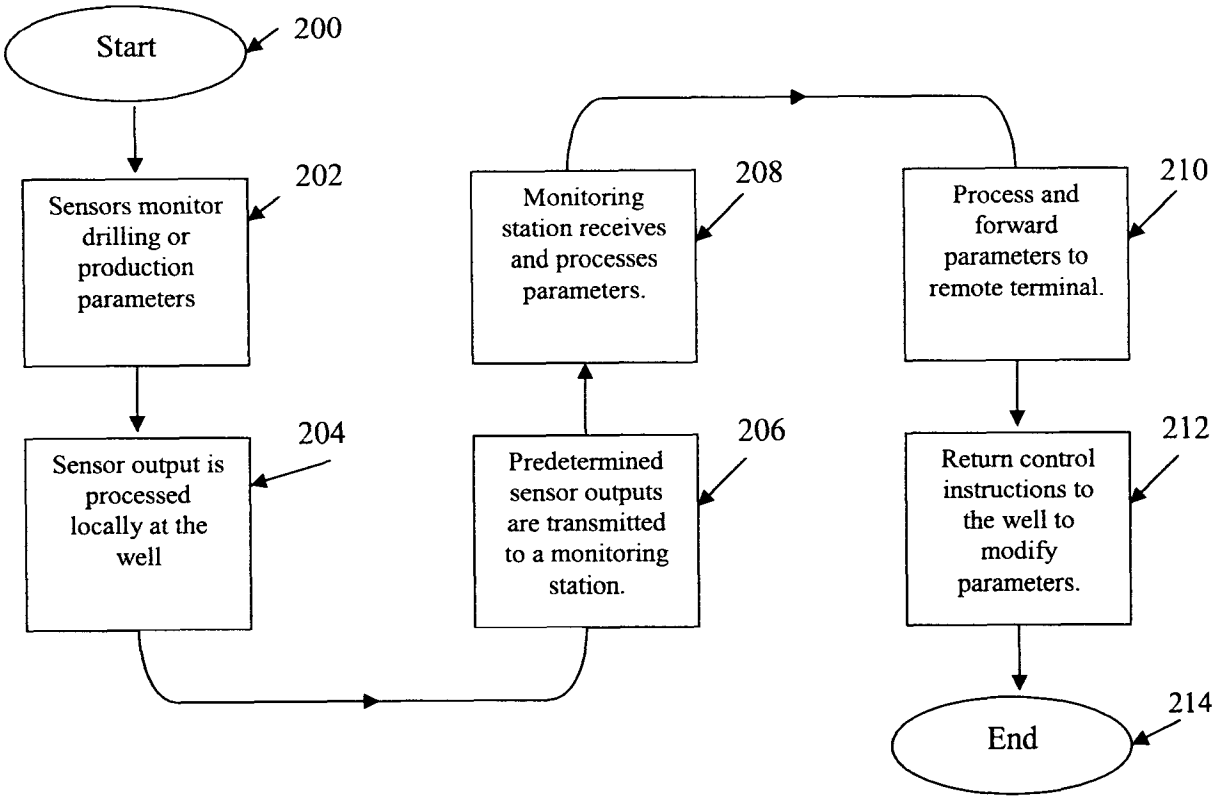
FIG. 2 illustrates a flowchart of an exemplary method of the invention.

FIG. 2 illustrates a flowchart of an exemplary method of the invention. The exemplary method begins at step 200 and continues to step 202, where sensors, such as sensors 108 illustrated in FIG. 1, monitor well drilling or production parameters (as noted above). The output of the sensors is received and processed locally proximate the well at step 204. The local processing of the sensor outputs, which may be completed by an alerts module, for example, is used to determine which ones of the sensed parameters is to be transmitted to a remote monitoring station, such as the well monitoring station 104 illustrated in FIG. 1, at step 206. At step 208 the monitoring station receives the determined sensed parameters. The monitoring station processes the received parameters and determines which of the received parameters are to be forwarded to the remote user terminal at step 210. At step 212 of the exemplary method, the remote user terminal processes the received parameters, generates a response, and transmits the response back through the system (system 100, for example) to the alerts module 106 and the well operation control 110, where the response is used to modify or adjust a physical condition or parameter at the well.

Therefore, the exemplary system and method of the invention allows for an oil drilling or production operator or other personnel to be removed from the well drilling platform, while still allowing the expert to monitor and make adjustments to the drilling or production process for the well. The system and method of the invention generally provide the production manager or other skilled personnel, often referred to as an expert, positioned at a remote terminal with an alert when a well drilling or production parameter is outside of a desired or normal range. The expert may then send instructions back to the well platform, where the instructions are calculated to address the parameter that is outside of the desired or normal range. Therefore, the exemplary system of the invention allows a single expert to set alert parameters for a plurality of well drilling operations and then each of the well drilling operations are individually monitored for unusual activity. When a parameter at the well is outside of a normal range, the system alerts the expert of the potential problem and allows the expert to send a control or warning message to the specific drilling rig having the problem that is calculated to correct the problem. Thus, the exemplary system of the invention allows for a single expert to remotely monitor and control a plurality of wells.

In an exemplary embodiment of the invention, parameters that are transmitted from the well location 112 to the monitoring station 104 and the remote user terminal 102 are predetermined. For example, an expert working at the remote user terminal 102 may select certain well drilling or processing alert parameters (for one or more particular wells) to be monitored at a particular well site 112. These alert parameters may be transmitted from the remote user terminal 102 to the well monitoring station 104. The well monitoring station 104 stores the specific user's selected alert parameters and monitors the incoming data from the alerts module 106 at the selected well. When the incoming data indicates that a parameter at the well is outside of a predetermined range, as defined by the user's selected alert parameters, then the well monitoring station 104 sends an alert message to the remote user terminal 102. The alert message details the current state of the well and illustrates the alert parameters to the remote user. The remote user may then send a control message back to the well, generally to the well operation control module 110, that adjusts the operation of the well to address the alert.

In another embodiment of the invention, an expert user's alert parameters may be stored in the alerts module 106. In this embodiment, the alerts module 106 operates to receive and monitor the sensor information to determine if a parameter at the well is outside of a predetermined range, as defined by the user's selected alert parameters. If a sensed parameter is outside of a normal or desired range, the alerts module 106 sends an alert message to the remote user terminal 102 via the well monitoring system 104. The alert message details the current state of the well and illustrates the alert parameter to the expert user. The expert user may then send a control message back to the well, generally to the well operation control module 110, that adjusts the operation of the well to address the alert.

In another exemplary embodiment of the invention, sensed parameters to be transmitted from the alerts module 106 to the well monitoring station 104 or the remote user terminal 102 may be temporarily stored at the well location before being transmitted. More particularly, in the situation where the communications medium between the alerts module 106 and the well monitoring station 104 is temporarily inoperative, the alerts module 106 may be configured to store the sensed parameters. In this scenario, the communications medium may be monitored to determine when communications are possible, and the stored data that relates to any alert specified by the expert user may be transmitted in an expedited manner (with priority over other data).

In another embodiment, when a first or primary communications medium between alerts module 106 and the well monitor 104 fails, the alerts module 106 may be configured to search for and utilize an alternative communications medium, especially in the situation where an alert parameter has been identified and needs to be transmitted to the expert user. If an alternative communications medium is not available, the alerts module 106 may wait for communications to be re-established, and possibly alert a local rig manager. The expert's predetermined alert may be presented to the local rig manager for action absent the expert's input. Once the communication channel is restored, the alerts module 106 may urgently send the alerts information to the expert at the remote terminal 102.

In another exemplary embodiment of the invention, use of the remote user terminal may be a subscription-type service. More particularly, the users may be required to pay a subscription fee or register for a subscription prior to being able to use the remote monitoring system of the exemplary embodiments of the invention. The subscription service enables the owner of the system to control access to the system and prevent unauthorized parties from sending control signals to the well operation control module 110.

In another exemplary embodiment of the invention, the expert may pre-select specific parameters at a remote well to be monitored. The expert sends these pre-selected parameters to the well monitoring station (or the alerts module), and the pre-selected parameters are be stored therein. Thereafter, the alerts module or the well monitoring station may operate to compare received parameters from the well to the expert's pre-selected parameters to determine if an alert condition exists, where an alert condition is generally defined as the condition where a sensed parameter from the well falls into a range for that parameter identified by the expert as being of concern. Thus, when this happens, the expert receives an alert warning that the particular parameter is at a value that is of concern.

In another exemplary embodiment of the invention, the monitoring station 104 uses what is referred to be the inventors as the "escalation concept," which is generally the process of notifying a different group of people or agents when an initial group could not or was not able to take action in response to an alert for some reason. This escalation to another group or monitoring person is generally done to prevent a problem situation from going unaddressed. Therefore, in an exemplary embodiment, an alert that is available today may have escalation policies that are based on the alert itself, and if the notification on the alert as not been acknowledged and acted upon within a predetermined time period, an alert engine may escalate it. The alert engine may be a software routine or a hardware device configured to monitor alerts and responses thereto to determine when an escalation alert or message should be sent. The alert engine may be positioned in the well monitoring station 104, in the alerts module 106, or in a separate location that is in communication with the alerts generating portion of the system of the invention. The monitoring station's 104 escalation concept is unique because it is based on a business object instance, and the business object instance is the actual embodiment of the business object. For instance, if a top drive business object is defined in the database, top drive with Serial#12345 is the business object instance. Because of the dynamic nature of the alert definition, an alert condition could cause notifications to be put out on multiple business object instances. Due to the nature of the business, different personnel have different access privileges to these BO instances. Hence acknowledgement can be done only BO instances that a person has access to. In other words, escalation should also be done based on the BO instance. This is a very unique feature and the actual handling of this in the Monitoring station 104 is unique as well.

For instance, if an alert is created monitoring all engines that need maintenance. The alert definition would look for any engine that had a last maintenance date that is more than three months old. This alert may fetch 5 engines that will require maintenance now. However, not all the recipients of this alert notification may have access to these engines. If user A has access to only two engines and user B has access to the other remaining three engines, then if acknowledgement is alert based and user A maintains his two engines and acknowledges the alert notification, then user B will never know that there were three other engines that needed maintenance. The business object based acknowledgement prevents this from happening. This is a unique concept.

Each user that could be a notification recipient could have multiple channels of notification available to him, e.g., email, phone, pager, SMS (text messaging), fax, etc. Escalation of a notification happens along the channels line as well. For instance, the first notification goes to the email addresses of all the recipients. If an acknowledgement is not received within a certain amount of time, a notification is sent to the recipients' hand held device. The notification is then escalated to the recipients' mobile phone where a pre-recorded message is played back. Once all the channels of notification are exhausted for the first level of recipients and no acknowledgement occurs, then the alert is escalated to the next level of recipients who have their own set of notification channels.

As noted above, embodiments of the invention contemplate that the comparison of the sensed parameters to the expert's pre-selected alert parameters may be conducted in either the alerts module or in the well monitoring station. In embodiments where all of the sensed parameters from the well are transmitted to the well monitoring station, the comparison and alert determination may be conducted at the well monitoring station. Alternatively, in embodiments where communications bandwidth between the alerts module and the well monitoring station is limited, the alerts module may be configured to store the expert's pre-selected parameters and compare sensed parameters to the stored parameters to determine if an alert condition exists. Thus, only the alert condition information would need to be transmitted to the well monitoring station or the remote terminal.

Although only a few exemplary embodiments have been described in detail above, those skilled in the art will readily appreciate that many modifications are possible in the exemplary embodiments without materially departing from the novel teachings and advantages of this disclosure. Accordingly, all such adjustments and alternatives are intended to be included within the scope of the invention, as defined exclusively in the following claims. Those skilled in the art should also realize that such modifications and equivalent constructions or methods do not depart from the spirit and scope of the present disclosure, and that they may make various changes, substitutions, and alternations herein without departing from the spirit and scope of the present disclosure. Additionally, it is contemplated that any combination of the above noted exemplary embodiments or elements thereof may be used, as the invention is not limited to any particular combination of the above noted exemplary embodiments or elements thereof.

What is claimed is:

1. A system, comprising:

an alerts module positioned proximate a well and configured to monitor a well component;

a plurality of well parameter sensors in communication with the alerts module;

a well operation control module in communication with the alerts module;

an actuator coupled to the well component and in communication with the well operation control module;

a remotely positioned well monitoring station in communication with the alerts module; and a user terminal in communication with and remote from the well monitoring station, wherein sensed well parameters obtained by the plurality of sensors are locally processed by the alerts module to determine if a sensed well parameter is a predetermined parameter selected by a user for transmission, and the alerts module decides which sensed well parameters should be transmitted to the well monitoring station based on the determination, wherein the remote user terminal modifies one or more sensed well parameters forwarded by the well monitoring station based on information desired by the user, and transmits the one or more modified sensed well parameters to the well monitoring station;

wherein the well monitoring station:

receives the determined sensed well parameters from the alerts module;

forwards sensed well parameters from the alerts module to the remote user terminal;

receives the one or more modified sensed well parameters from the remote user terminal; and provides the received modified sensed well parameters to the well operation control module, wherein one of the well operation control module and the well monitoring station is in bidirectional communication with the alerts module;

wherein the well operation control module outputs the received modified sensed well parameters to the actuator and, in response, the actuator physically adjusts the well component; and wherein, in response to a communications medium between the alerts module and the well monitoring station being inoperative such that the well monitoring station is temporarily unable to communicate with the alerts module, the alerts module alerts local personnel of each alert and stores each alert until the communications medium between the alerts module and the well monitoring station is operative and, upon the communications medium becoming operative, the alerts module immediately transmits each of the stored alerts to the well monitoring station using the communications medium.

2. The system of claim 1, wherein the well operation control module and the well monitoring station are both in bidirectional communication with the alerts module.

3. The system of claim 1, wherein the well comprises a remote drilling platform and the well monitoring station is land based.

4. The system of claim 3, wherein the alerts module is positioned on the remote drilling platform and is in communication with the well monitoring station via a satellite communication system.

5. The system of claim 4, wherein the alerts module transmits the sensed well parameters to the well monitoring station via the satellite communication system, and wherein the well monitoring station compares the sensed well parameters to predetermined alert conditions.

6. The system of claim 5, wherein the alerts module stores sensed well parameters when the satellite communications system is not operational and reattempts transmission of the sensed well parameters when the satellite communications system becomes operational.

7. The system of claim 1, wherein the well monitoring station analyzes the received sensed well parameters, determines if an alert condition has occurred, and transmits alert information to the remote user terminal when an alert condition is determined.

8. The system of claim 1, wherein the remote user terminal transmits well control information to the well operation control module in response to alert information.

9. A computer program embodied on a non-transitory computer readable medium, wherein the computer program controls a method for remotely monitoring a well drilling process, comprising:

receiving and processing, by an alerts module that is located in a remotely positioned well and that is monitoring a well component, sensed well parameters to determine if a sensed well parameter is a predetermined parameter selected by a user for transmission;

deciding, by the alerts module, which sensed well parameters should be transmitted to a well monitoring station based on the determination;

receiving, by the well monitoring station, the determined sensed well parameters;

generating, by the well monitoring station, a comparison of the received sensed well parameters to predefined alert conditions for the well component;

determining, by the well monitoring station, when an alert condition exists for the well component based on the generated comparison;

transmitting, by the well monitoring station, an alert condition warning to a land based remote terminal when an alert condition is determined;

receiving, by the well monitoring station, a well operation parameter adjustment instruction from the land based remote terminal, wherein the well operation parameter adjustment instruction addresses the alert condition; and transmitting the well operation parameter adjustment instruction to a well operation control module positioned at the remotely positioned well, wherein the well operation control module outputs the well operation parameter adjustment instruction to an actuator that is coupled to the well component and, in response, the actuator performs a physical well operation parameter adjustment on the well component that addresses the alert condition;

wherein in response to a communications medium between the alerts module and the land-based remote terminal being inoperative such that the alerts module is temporarily unable to communicate with the land based remote terminal, the alerts module alerts local personnel of each alert and stores the alert condition warning until the communications medium between the alerts module and the land-based remote terminal is operative and, upon the communications medium between the alerts module and the land based remote terminal becoming operative, the alerts module immediately transmits each stored alert condition warning to the land-based remote terminal using the communications medium.

10. A method which comprises:

receiving and processing, by an alerts module that is located in a remotely positioned well and that is monitoring a well component, sensed well parameters to determine if a sensed well parameter is a predetermined parameter selected by a user for transmission;

deciding, by the alerts module, which sensed well parameters should be transmitted to a well monitoring station based on the determination;

receiving, by the well monitoring station, the determined sensed well parameters;

generating, by the well monitoring station, a comparison of the received sensed well parameters to predefined alert conditions for the well component;

determining, by the well monitoring station, when an alert condition exists for the well component based on the generated comparison;

transmitting, by the well monitoring station, an alert condition warning to a land based remote terminal when an alert condition is determined;

receiving, by the well monitoring station, a well operation parameter adjustment instruction from the land based remote terminal; and transmitting the well operation parameter adjustment instruction to a well operation control module positioned at the remotely positioned well, wherein the well operation control module outputs the well operation parameter adjustment instruction to an actuator that is coupled to the well component and, in response, the actuator performs a physical well operation parameter adjustment on the well component;

wherein in response to a communications medium between the alerts module and the land-based remote terminal being inoperative such that the alerts module is temporarily unable to communicate with the land-based remote terminal, the alerts module alerts local personnel of each alert and stores the alert condition warning until the communications medium between the alerts module and the land-based remote terminal is operative and, upon the communications medium between the alerts module and the land-based remote terminal becoming operative, the alerts module immediately transmits each stored alert condition warning to the land-based remote terminal using the communications medium.

11. The method of claim 10, wherein the well operation parameter adjustment instruction addresses the alert condition, and wherein transmitting the well operation parameter adjustment instruction to the well operation control module triggers the physical well operation parameter adjustment on the well component that addresses the alert condition.

12. The method of claim 10, wherein receiving sensed well parameters comprises monitoring a drilling process at the well via a plurality of sensors each in communication with the alerts module.

13. The method of claim 10, wherein the well monitoring station is land based, and wherein the alerts module is positioned on a remote drilling platform and is in communication with the land based well monitoring station via a satellite communications system.

14. The method of claim 10, wherein the well monitoring station is land based, and wherein the alerts module is positioned on a remote drilling platform and is in communication with the land based well monitoring station via a hard wire communications system.

* * * * *